US008218996B2

(12) United States Patent
Shimizu

(10) Patent No.: US 8,218,996 B2
(45) Date of Patent: Jul. 10, 2012

(54) IMAGE FORMING APPARATUS WITH IMPROVED VENTILATION

(75) Inventor: Keisuke Shimizu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 414 days.

(21) Appl. No.: 12/461,731

(22) Filed: Aug. 21, 2009

(65) Prior Publication Data

US 2010/0054791 A1 Mar. 4, 2010

(30) Foreign Application Priority Data

Aug. 26, 2008 (JP) ..... 2008-216571

(51) Int. Cl.
*G03G 21/20* (2006.01)

(52) U.S. Cl. ..... 399/92

(58) Field of Classification Search ..... 399/92, 399/94, 328, 329
See application file for complete search history.

(56) References Cited

U.S. PATENT DOCUMENTS

| | | | | |
|---|---|---|---|---|
| 7,454,157 | B2 | 11/2008 | Yamada et al. | |
| 7,469,112 | B2 * | 12/2008 | Yuasa | 399/92 |
| 7,558,502 | B2 * | 7/2009 | Kanai | 399/92 |
| 7,715,747 | B2 * | 5/2010 | Kitozaki | 399/92 |
| 7,890,014 | B2 * | 2/2011 | Koshida | 399/92 |
| 2007/0059036 | A1 | 3/2007 | Yamada et al. | |
| 2007/0196152 | A1 | 8/2007 | Shimizu et al. | |
| 2008/0025751 | A1 | 1/2008 | Andoh et al. | |

FOREIGN PATENT DOCUMENTS

| | | |
|---|---|---|
| JP | 11-296053 | 10/1999 |
| JP | 2000-221867 | 8/2000 |
| JP | 2002-333814 | 11/2002 |
| JP | 2003-307996 | 10/2003 |
| JP | 2005-010767 | 1/2005 |
| JP | 2005-258318 | 9/2005 |
| JP | 2007-148102 | 6/2007 |

* cited by examiner

*Primary Examiner* — William J Royer

(74) *Attorney, Agent, or Firm* — Harness, Dickey & Pierce, PLC

(57) ABSTRACT

An image forming apparatus including a fixing unit; a discharge unit; a stacking unit; an inversion guide; a cooling fan; an opening; a duct; and a second duct, wherein the discharge unit is provided on a downstream side of the side end of the fixing unit in a paper discharge direction, and an air flow direction from the duct toward the second duct is substantially matched with a direction in which hot air above the fixing unit is taken in by the cooling fan.

8 Claims, 8 Drawing Sheets

IMAGE FORMING APPARATUS WITH IMPROVED VENTILATION

BACKGROUND OF THE INVENTION

1. Field of the Invention

The present invention relates to an image forming apparatus such as a copying machine, a printer, and a facsimile.

2. Discussion of the Related Art

FIG. 1 illustrates a printer 1 that is an example of a conventional image forming apparatus in which an electrophotographic system is used. An optical device 20 irradiates an image forming device 10Y, 10C, 10M and 10K with light, the image forming device 10Y, 10C, 10M and 10K forms a toner image, and a transfer unit 30 conveys and transfers the toner image to a sheet material P. On the other hand, a paper feed roller 41 picks up the sheet material P stacked on a sheet material supplying device 40, the sheet material P is conveyed from a registration roller 42 to the transfer unit 30, and the toner image is transferred to the sheet material P. Then a fixing unit 50 heats and fixes the toner image to the sheet material P, the sheet material P is conveyed to a sheet material discharge roller 60, and the sheet material P is stacked on a sheet material stacking unit 70.

Because the fixing unit 50 heats and fixes the toner image, the inside of the fixing unit 50 may reach extremely high temperatures. Therefore, heat is transmitted from the fixing unit 50 to a periphery of the fixing unit 50, particularly in the transfer unit 30 or a toner storage device 80, which causes a risk of melting toner.

The sheet material P on which the toner image is fixed by the fixing unit 50 also may reach high temperatures, and the sheet material P emits the heat between the fixing unit 50 and the sheet material discharge roller 60. The heat increases temperatures of electric components, such as a sensor 90, which are provided in a conveying path between the fixing unit 50 and the sheet material discharge roller 60. When the temperature of the electric component exceeds an allowable temperature, a trouble is possibly caused in the electric component. When the sheet material P is stacked at a high temperature on the sheet material stacking unit 70 while insufficiently cooled, the toner on the sheet material P stacked on the sheet material stacking unit 70 is possibly melted to cause a trouble in that the sheet materials P adhere to each other.

Recently demands for downsizing of the machine and improvement of productivity rise in the market, and cooling of the fixing and the thermally-fixed sheet material become a large issue.

Therefore, various countermeasures against the issue have been proposed to cool the fixing and the thermally-fixed sheet material. For example, in an image forming apparatus disclosed in Japanese Patent Application Laid-Open No. 2003-307996, exhaust heat units are provided near a fixing unit and a discharge and stacking unit, and ventilation holes are respectively made between the fixing unit and the exhaust heat unit and between the discharge and stacking unit and the exhaust heat unit, thereby cooling a sheet material and a path between the fixing unit and the discharge and stacking unit.

In an image forming apparatus disclosed in Japanese Patent Application Laid-Open No. 2005-10767, a cooling fan is disposed opposite a discharge conveying path in order to generate a flow from an image forming unit side toward a discharge conveying path, and outlets are provided in the discharge conveying path opposite the cooling fan and a sidewall, thereby cooling a sheet material after fixing.

In an image forming apparatus disclosed in Japanese Patent Application Laid-Open No. 2002-333814, a duct is provided in a cooling fan provided in the apparatus in order to guide air to a paper discharge unit, and the outlet of the duct is opened immediately after a sheet exit, which allows a sheet discharged from a paper discharge port to be directly cooled after fixing.

In an image forming apparatus disclosed in Japanese Patent Application Laid-Open No. 2005-258318, an intake is provided along a recording material conveying path in an outer frame in an opposite direction to a heating unit that heats an image, an outlet and exhaust fan are provided in an outer frame on the heating side, and an intake fan is provided in an air flow path between the intake and the outlet, in a midpoint of the heating unit on the air flow path and the outlet, and in a central portion in a lengthwise direction of the heating unit. Therefore, the periphery of a fixing unit and a recording material after fixing are cooled.

In the image forming apparatus disclosed in Japanese Patent Application Laid-Open No. 2003-307996, exhaust heat units are provided near the fixing unit and the discharge and stacking unit, a ventilation hole is made between the discharge and stacking unit and the exhaust heat unit. When the sheet materials are gradually stacked on the discharge and stacking unit, the ventilation hole is gradually closed to stop wind flow. Even if the ventilation hole is not completely closed, the sheet materials stacked on the discharge and stacking unit become high temperature because of the sheet material heated and fixed by the fixing unit. Therefore, the heat of the sheet material is taken in the machine, and possibly a cooling effect is insufficiently exerted.

In the image forming apparatus disclosed in Japanese Patent Application Laid-Open No. 2005-10767, the cooling fan is provided in a region from the fixing unit to the outlet, and an air flow blows the sheet material after the fixing by the cooling fan, thereby cooling the sheet material. The cooling fan is disposed in the apparatus while facing a discharge conveying path, whereby the heat emitted from the fixing unit is blocked so as not be transmitted to the periphery of the fixing unit. However, because the cooling fan is disposed in the apparatus, a pressure loss is increased, and it is necessary to enlarge the fan in order to obtain a predetermined air volume, which possibly influence the machine size. Particularly, in the high-productivity machine, a lack of air volume is probably generated only by the cooling fan provided in the apparatus.

In the image forming apparatus disclosed in Japanese Patent Application Laid-Open No. 2002-333814, the duct is provided in the cooling fan provided in the apparatus in order to guide the air to the paper discharge unit, and the outlet of the duct is opened immediately after the sheet exits, so that the sheet discharged from a paper discharge port can directly be cooled. Therefore, the sheet after the fixing is sufficiently cooled. However, except for the sheet after the fixing, particularly the electric component located in the conveying path from the fixing unit to the paper discharge port or the periphery of the fixing unit is insufficiently cooled.

In the image forming apparatus disclosed in Japanese Patent Application Laid-Open No. 2005-258318, an air flow path is ensured along the conveying path, and the intake and the outlet are provided in the end portion, that is, in the outer frame of the apparatus, and the exhaust fan is provided in the outlet or the intake fan is provided in the air flow path, thereby cooling the periphery of the fixing unit and the sheet material after fixing. However, the air flow path is ensured along the conveying path, and the cooling fan is provided in the air flow path. Therefore, it is necessary to largely ensure the air flow path, which advantageously enlarge the machine.

SUMMARY

Accordingly, an object of the inventive concepts is to provide an image forming apparatus having a configuration, in which the heat transmission from the fixing unit to the periphery is blocked without enlarging the machine and the sheet material is cooled after fixing, so that the adhesion of the sheet material on the sheet material stacking unit and the trouble with the heat of the electric component in the sheet material conveying unit and the component near the fixing unit can be prevented.

A first aspect of the inventive concepts relates to an image forming apparatus including: a fixing unit that heats and fixes a sheet in which an image is formed; a discharge unit that is provided above the fixing unit to discharge the sheet passing through the fixing unit; a stacking unit on which the sheet discharged from the discharge unit is stacked; an inversion guide that is provided above the fixing unit to inverse the sheet passing through the fixing unit; a cooling fan that is disposed while facing a guide surface of the inversion guide; an opening that is provided in the guide surface of the inversion guide to form a flow passage of the cooling fan; a duct that is formed between the stacking unit and the fixing unit to take in ambient air; and a second duct that is formed between a side end of the fixing unit and an uprising wall to guide air from the duct above the fixing unit, the uprising wall being an upstream end of the stacking unit, wherein the paper discharge unit is provided on a downstream side of the side end of the fixing unit in a paper discharge direction, and an air flow direction from the duct toward the second duct is substantially matched with a direction in which hot air above the fixing unit is taken in by the cooling fan.

In the image forming apparatus according to an aspect of the inventive concepts, a second aspect of the inventive concepts relates to an image forming apparatus wherein a ventilation hole is disposed adjacent to a fixing unit.

In the image forming apparatus according to the first or second aspect of the inventive concepts, a third aspect of the inventive concepts relates to the image forming apparatus wherein a ventilation hole is disposed across a sheet material conveying unit from the cooling fan.

In the image forming apparatus as in any one of the first to third aspects of the inventive concepts, a fourth aspect of the inventive concepts relates to the image forming apparatus wherein the cooling fan is disposed in a position except for a neighborhood of an outlet through which a sheet is discharged from the sheet material conveying unit to stacking unit.

In the image forming apparatus according to the fourth aspect of the inventive concepts, a fifth aspect of the inventive concepts relates to the image forming apparatus wherein the cooling fan is disposed near an extended line of a line connecting the ventilation hole and sheet material conveying unit.

In the image forming apparatus as in any one of the first to fifth aspects of the inventive concepts, a sixth aspect of the inventive concepts relates to the image forming apparatus, comprising a duct that guides ambient air from the ventilation hole to the sheet material conveying unit.

In the image forming apparatus according to the sixth aspect of the inventive concepts, a seventh aspect of the inventive concepts relates to the image forming apparatus wherein part of the duct is disposed between the fixing unit and a transfer unit.

In the image forming apparatus according to the sixth or seventh aspect of the inventive concepts, an eighth aspect of the inventive concepts relates to the image forming apparatus wherein a toner storage device is disposed across the duct from the fixing unit.

According to the inventive concepts, the ambient air introduced from the ventilation hole is guided to the cooling fan through the conveying path of the sheet. Therefore, the sheet material is efficiently cooled after fixing because of the direct exposure of the sheet to the ambient air, and the conveying path of the sheet is cooled by the ambient air, so that the sheet can be cooled after fixing while the heat from the fixing unit is blocked.

These and other objects, features and advantages of the inventive concepts will become apparent upon consideration of the following description of the preferred embodiments of the inventive concepts taken in conjunction with the accompanying drawings.

DESCRIPTION OF THE PREFERRED EMBODIMENTS

Figure 1:
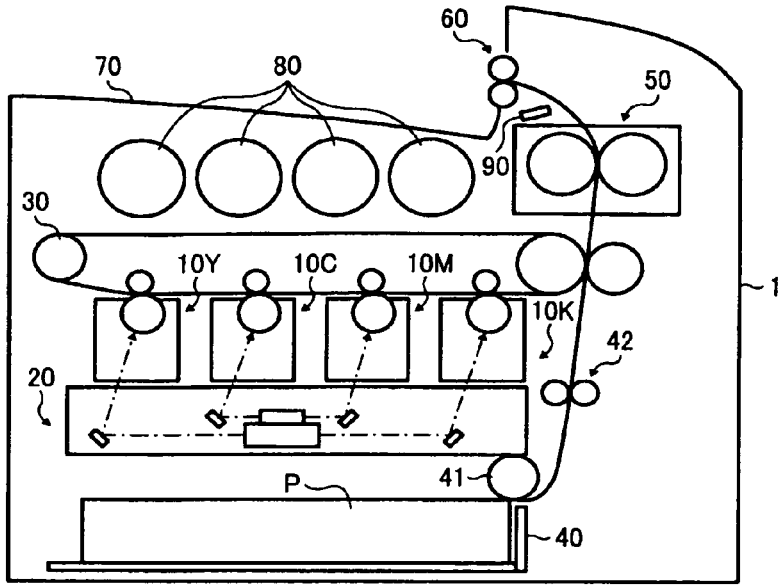
FIG. 1 CONVENTIONAL ART
FIG. 1 is a schematic sectional view illustrating a printer that is an example of a conventional image forming apparatus in which an electrophotographic system is used.

Generally, the inventive concepts provide an image forming apparatus. Although a printer is described by way of example in the following embodiments, the inventive concepts are not limited to the printer, but the inventive concepts can be applied to various image forming apparatuses.

A first object of the inventive concepts is to provide an image forming apparatus having a configuration, in which heat transmission from the fixing unit to the periphery is blocked without enlarging the apparatus and the sheet material is cooled after fixing, so that the adhesion of the sheet material on the sheet material stacking unit and the trouble with the heat of an electric component in the sheet material conveying path and a component near the fixing unit can be prevented. The image forming apparatus includes a fixing unit 50 that heats and fixes a sheet on which an image is formed, a discharge unit 60 that is provided above the fixing unit 50 to discharge a sheet material P passing through the fixing unit 50, a stacking unit 70*b* on which the sheet material P discharged from the discharge unit 60 is stacked, double-sided guide 96 that is provided above the fixing unit 50 to invert the sheet material P passing through the fixing unit 50, a cooling fan 93 that is disposed while facing a guide surface of the double-sided guide 96, an opening 96*a* that is provided in the guide surface of the double-sided guide 96 to form a flow passage of the cooling fan 93, a duct 92 that is formed between the stacking unit 70*b* and the fixing unit 50 to take in ambient air, and a region 70*a* of a paper discharge unit, the region 70*a* constituting a second duct 70*a* that is formed between a side end of the fixing unit 50 and an uprising wall to guide air from the duct 92 above the fixing unit 50, the uprising wall being an upstream end of the stacking unit 70*b*. In the image forming apparatus, the discharge unit 60 is provided on a downstream side of the side end of the fixing unit 50 in a paper discharge direction, and an air flow direction from the duct 92 toward the second duct 70*a* is substantially matched with a direction in which hot air above the fixing unit 50 is taken in by the cooling fan 93. In the image forming apparatus, the ambient air introduced from the duct 92 is guided to the cooling fan 93 through a conveying path of the sheet material P. Therefore, the sheet material P is efficiently cooled after the fixing because of direct exposure of the sheet material P to the ambient air, and the conveying path of the sheet material P is cooled by the ambient air, so that the sheet material P can be cooled after fixing while the heat from the fixing unit 50 is blocked.

When an electrical component that is easily affected by heat or when a device including toner is disposed near the fixing unit 50, potential trouble such as electric component failure and adhesion of the toner in the device may be caused by heat radiated from the fixing unit 50. Therefore, a second object of the inventive concepts is to provide an image forming apparatus having a configuration in which the electric component or the device including the toner, located near the fixing unit 50, can be prevented from generating the trouble caused by the heat radiated from the fixing unit 50. The image forming apparatus includes a transfer unit 30 that transfers an image formed by an image forming device 100 of the image forming unit to the sheet material P, the fixing unit 50 that heats and fixes the sheet material P in which the image is formed, the sheet material stacking unit 70*b* on which the sheet material P to which the image is fixed is stacked, and a conveying path of the sheet material through which the sheet material P is conveyed from the fixing unit 50 to the sheet material stacking unit 70*b*. In the image forming apparatus, the cooling fan 93 is disposed on the side opposite the sheet material stacking unit 70*b* while facing the conveying path of the sheet material P, and a ventilation hole 91*a* communicated with the outside of the apparatus is provided below the conveying path of the sheet material P. Because the ventilation hole 91*a* is disposed adjacent to the fixing unit 50, the ambient air introduced from the ventilation hole 91*a* flows through the neighborhood of the fixing unit 50. Therefore, the heat radiated from the fixing unit 50 can be blocked, and the electric component and the device including the toner, located near the fixing unit 50, can be shielded from potential trouble that may be caused by the heat radiated from the fixing unit 50.

A third object of the inventive concepts is to provide an image forming apparatus having a configuration in which the heat of the fixing unit 50 is efficiently blocked from the components provided in the periphery of the fixing unit 50. Therefore, the ventilation hole 91*a* is disposed adjacent to the fixing unit 50. Because the ventilation hole 91*a* is disposed on the side of the sheet material stacking unit 70*b* in relation to the conveying path of the sheet material P, the ventilation hole 91*a* is provided inside the fixing unit 50 in the image forming apparatus. Therefore, the heat of the fixing unit 50 can efficiently be blocked from the components provided in the periphery of the fixing unit 50 in the image forming apparatus, and the trouble caused by the heat radiated from the fixing unit 50 can be prevented.

A fourth object of the inventive concepts is to provide an image forming apparatus in which the cooling fan 93 is properly disposed and the ambient air is introduced from the ventilation hole 91*a* so as to pass through the conveying path of the sheet material P. Unless the cooling fan 93 is properly disposed, the ambient air is introduced from the ventilation hole 91*a*, and possibly the air flow passing through the conveying path of the sheet material P is not generated. Accordingly, the sheet material P can efficiently be cooled after fixing, and the heat radiated from the fixing unit 50 can efficiently be blocked.

Fifth and sixth objects of the inventive concepts are to be able to enhance efficiency of the cooling fan 93 to more efficiently perform the cooling. That is, the cooling fan 93 is disposed near an extended line of a line connecting the ventilation hole 91*a* and a sheet material conveying unit, or the image forming apparatus includes the duct 92 that guides the ambient air from the ventilation hole 91*a* to the conveying path of the sheet material P. Therefore, the conveying path of the sheet material P is disposed on the straight line connecting the ventilation hole 91*a* and the cooling fan 93, and the linear flow is generated from the ventilation hole 91*a* to the cooling fan 93, thereby obtaining the flow having the low pressure loss and good efficiency. Accordingly, the efficiency of the cooling fan 93 is enhanced, so that the sheet material P can effectively be cooled after fixing and the heat radiated from the fixing unit 50 can be blocked. The pressure loss from the ventilation hole 91*a* to the conveying path of the sheet material P is decreased by providing the duct 92 that guides the ambient air from the ventilation hole 91*a* to the conveying path of the sheet material P, and the air volume generated by the cooling fan 93 is increased, so that the sheet material P can effectively be cooled after fixing and the heat radiated from the fixing unit 50 can be blocked.

A seventh object of the inventive concepts is to provide an image forming apparatus having a configuration in which the heat radiated from the fixing unit 50 can efficiently be blocked to prevent the trouble with the heat of the components near the fixing unit. Therefore, part of the duct 92 is disposed between the fixing unit 50 and the transfer unit 30 to block the heat radiated from the fixing unit 50 such that the heat is not transmitted to the transfer unit 30.

An eighth object of the inventive concepts is to be able to prevent the adhesion of the toner in toner storage devices 80Y, 80, 80M and 80K, (hereinafter "toner storage device 80"), provided near the fixing unit 50. The adhesion of toner in the toner storage device 80 is generated by the heat radiated from the fixing unit 50. Therefore, the toner storage device 80 is disposed across the duct 92 from the fixing unit 50, so that the heat radiated from the fixing unit 50 can be blocked by the ambient air flowing in the duct 92 to prevent the adhesion of the toner in the toner storage device 80, caused by the heat radiated from the fixing unit 50.

First Embodiment

Figure 2:
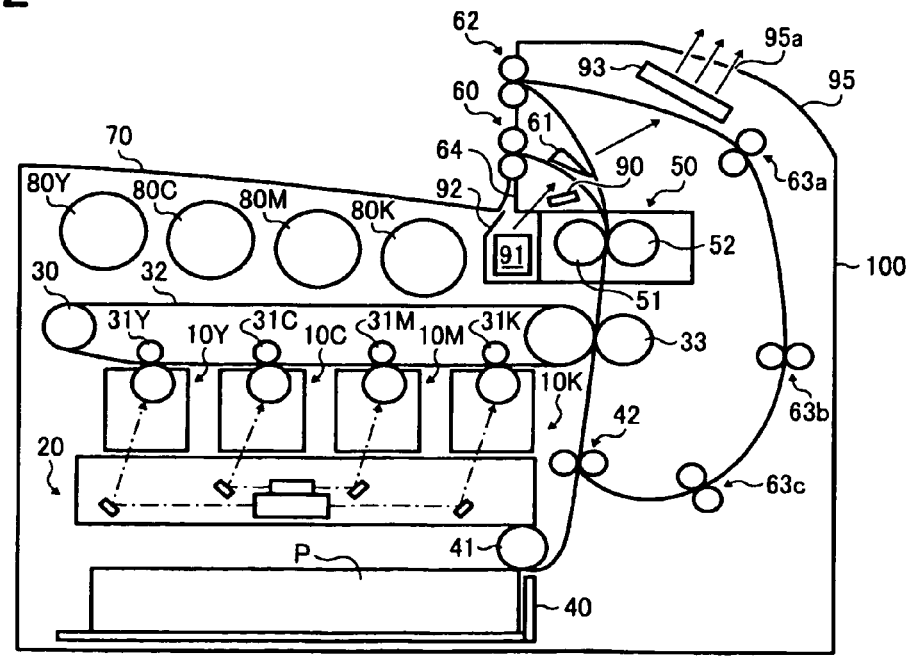
FIG. 2 is a sectional view illustrating a printer that is an example of an image forming apparatus according to a first embodiment of the inventive concepts.

FIG. 2 is a sectional view illustrating a printer 100 that is an example of the image forming apparatus according to a first embodiment of the inventive concepts. In FIG. 2, the configuration in common with that of FIG. 1 is designated by the same numeral.

Referring to FIG. 2, the printer 100 includes four color image forming devices 10Y (yellow), 10C (cyan), 10M (magenta), and 10K (black), an optical device 20 that is an exposure unit for being able to irradiate the image forming devices 10Y, 10C, 10M and 10K with a laser beam, the transfer unit 30 that conveys and transfers a toner image, a sheet material supplying unit 40, and the fixing unit 50. A paper feed roller 41 picks up the sheet material P stored in the sheet material supplying device 40, a registration roller 42 conveys the sheet material P to the transfer unit 30 while adjusting conveying timing of the sheet material P. On the other hand, the optical unit 20 irradiates the image forming devices 10Y, 10C, 10M, and 10K with the light to form toner images, and primary transfer rollers 31K, 31M, 31C, and 31Y perform primary transfer of the toner images to a transfer belt 32. A secondary transfer roller 33 performs secondary transfers of the toner images on the transfer belt 32 to the sheet material P. The sheet material P to which the toner images are transferred is thermally fixed by a heating roller 51 and a pressurizing roller 52 in the fixing unit 50.

After fixing, the sheet material P is guided to a sheet material discharge roller 60 by a branch pawl 61, and sheet material P is discharged to a sheet material stacking unit 70. In the case of both-sided printing, the branch pawl 61 is turned by a solenoid (not illustrated), the sheet material P to which the toner images are fixed by the fixing unit 50 is guided to an inversion roller 62, the inversion roller 62 is reversely driven to guide the sheet material P to double-sided rollers 63*a*, 63*b*, and 63*c*, and the toner images are transferred from the transfer belt 32 to a second surface of the sheet material P. Then the sheet material P to which the toner images are fixed by the fixing unit 50 is guided to the sheet material discharge roller 60 by the branch pawl 61, and the sheet material P is discharged to the sheet material stacking unit 70. The toner storage devices 80K, 80M, 80C, and 80Y are disposed in the same order as the image forming devices 10K, 10M, 10C, and 10Y, and the toner is supplied to the image forming device 10K, 10M, 10C, and 10Y as needed.

Figure 3:
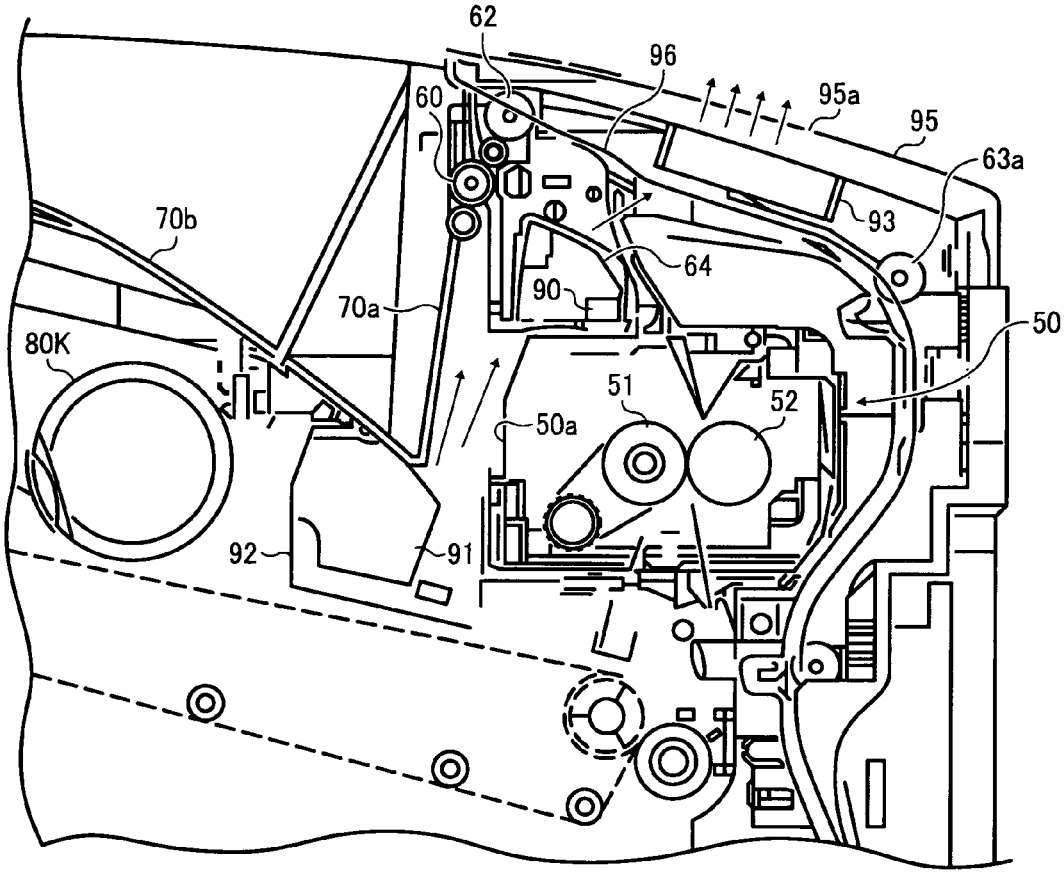
FIG. 3 is a detailed view illustrating a periphery of a fixing unit.
Figure 4:
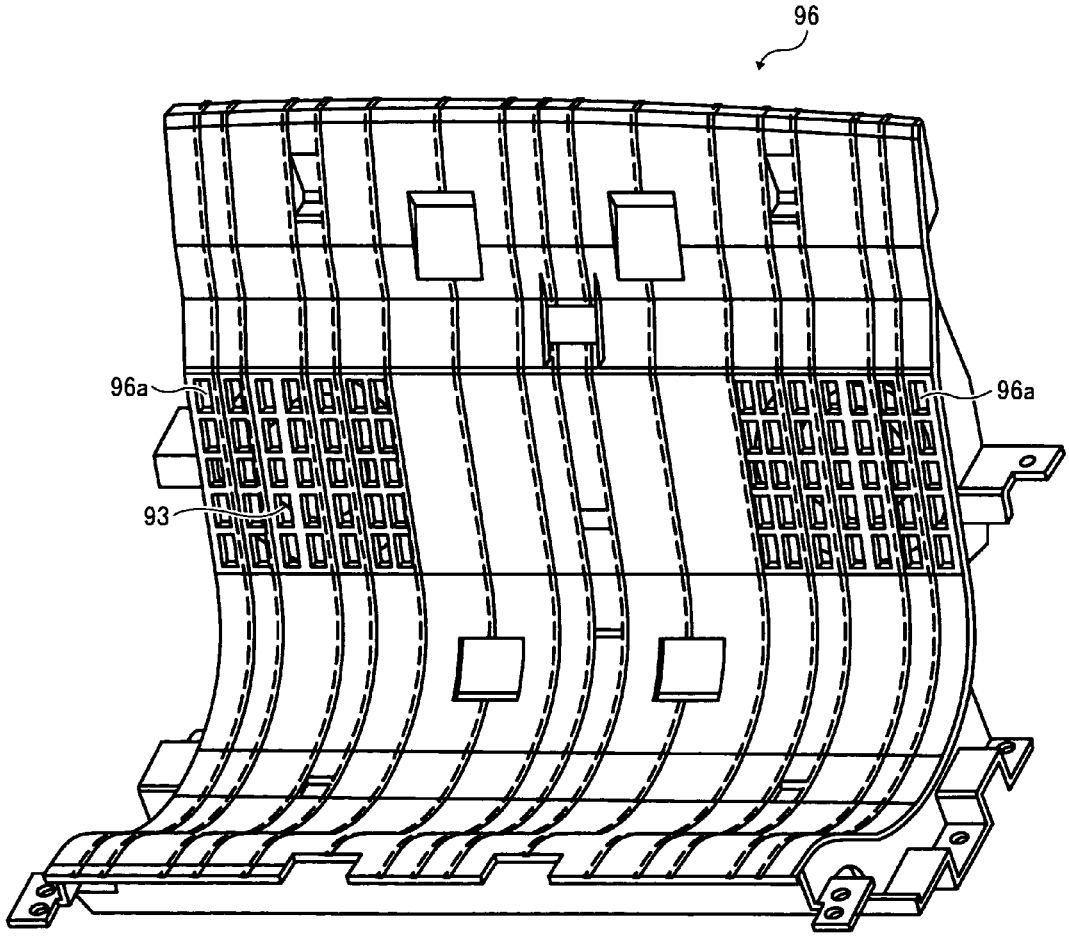
FIG. 4 is a perspective view illustrating the periphery of the fixing unit.
Figure 5:
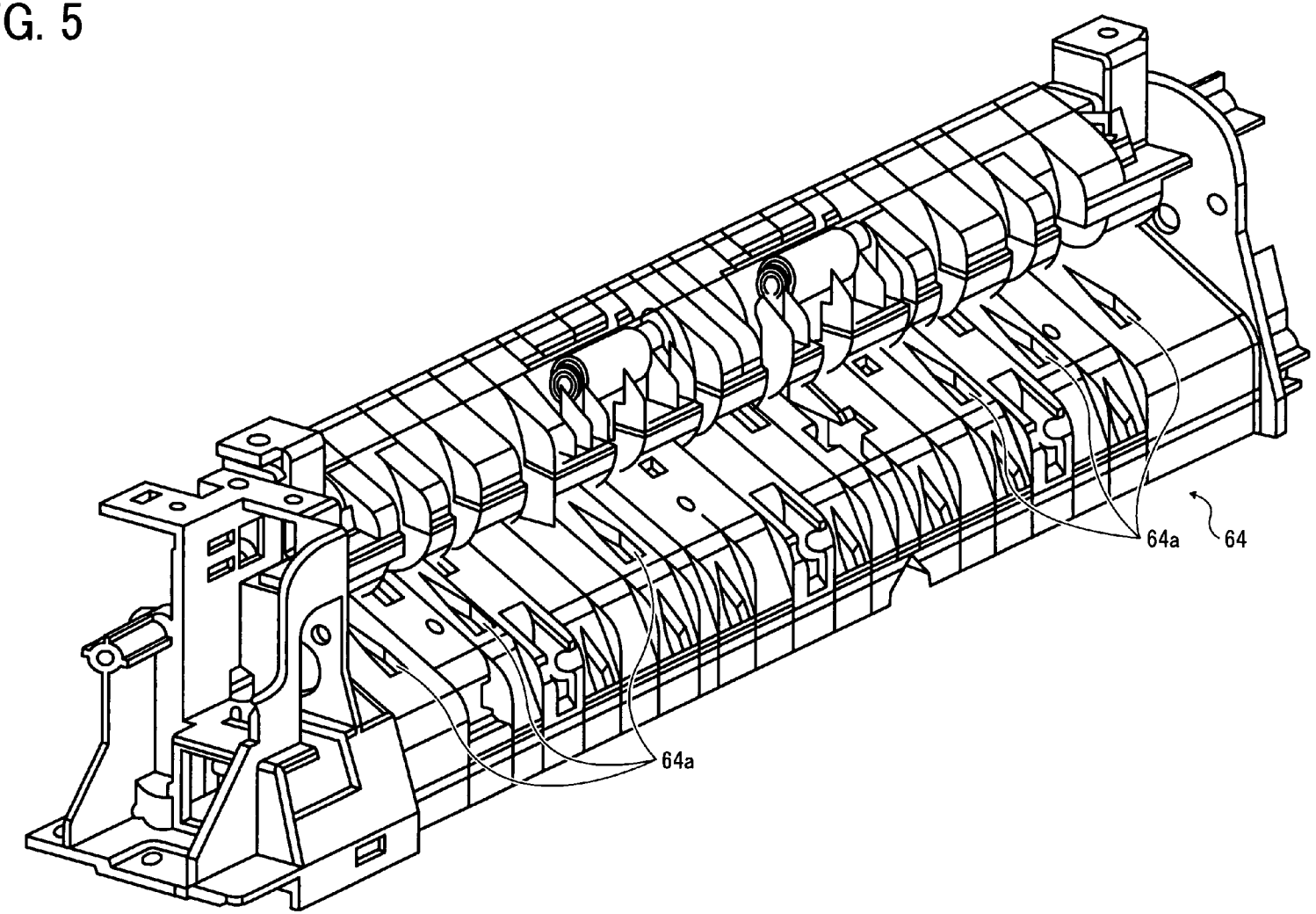
FIG. 5 is a perspective view illustrating the periphery of the fixing unit.

A periphery of the fixing unit 50 of the first embodiment will be described in detail with reference to FIGS. 3, 4, and 5. FIG. 3 is a detailed view illustrating the periphery of the fixing unit 50, and FIGS. 4 and 5 a perspective view illustrating the periphery of the fixing unit 50. In FIGS. 3, 4, and 5, the configuration in common with that of FIG. 2 is designated by the same numeral, and the description is not given.

As illustrated in FIG. 3, an intake 91 is provided at the back of the fixing unit 50, and the duct 92 is provided so as to surround the intake 91. On the other hand, the cooling fan 93 is provided between the inversion roller 62 and the double-sided roller 63*a* while facing a sheet material discharge guide 64. As shown in FIGS. 4 and 5, the cooling fan 93 is retained by the inversion guide 65 or a double-sided guide 96, and the opening or slit 96*a* that is of the intake or ventilation hole 91 is provided in the position of the cooling fan 93. Similarly plural slits 64*a* that are of the ventilation hole 91 are provided in the sheet material discharge guide 64 of FIG. 5.

The ambient air taken in from intake 91 by the cooling fan 93 passes through intervals between a back surface 50*a* of the fixing unit 50 and the duct 92 and between the back surface 50*a* of the fixing unit 50 and a paper discharge tray 70*a* to cool a paper discharge sensor 90 provided in the sheet material discharge guide 64, the ambient air passes through the slit 64*a* of the sheet material discharge guide 64 and the slit 96*a* of the double-sided guide 96, and the ambient air is exhausted from a slit 95*a* provided in a cover 95. The ambient air directly blows the image surface side of the sheet material P that becomes high temperature by the thermal fixing of the fixing unit 50, thereby efficiently cooling the sheet material P. The ambient air also directly blows the paper discharge sensor 90 in the sheet material discharge guide 64, so that the paper discharge sensor 90 can be prevented from exceeding the allowable temperature. The ventilation hole 91 and the duct 92 are disposed between the fixing unit 50 and the toner storage device 80K, so that the heat radiated from the fixing unit 50 can be blocked to prevent the toner adhesion caused by the heat of fixing in the toner storage device 80K. Arrows illustrated in FIGS. 2 and 3 indicate the air flow generated by the cooling fan 93.

Figure 6:
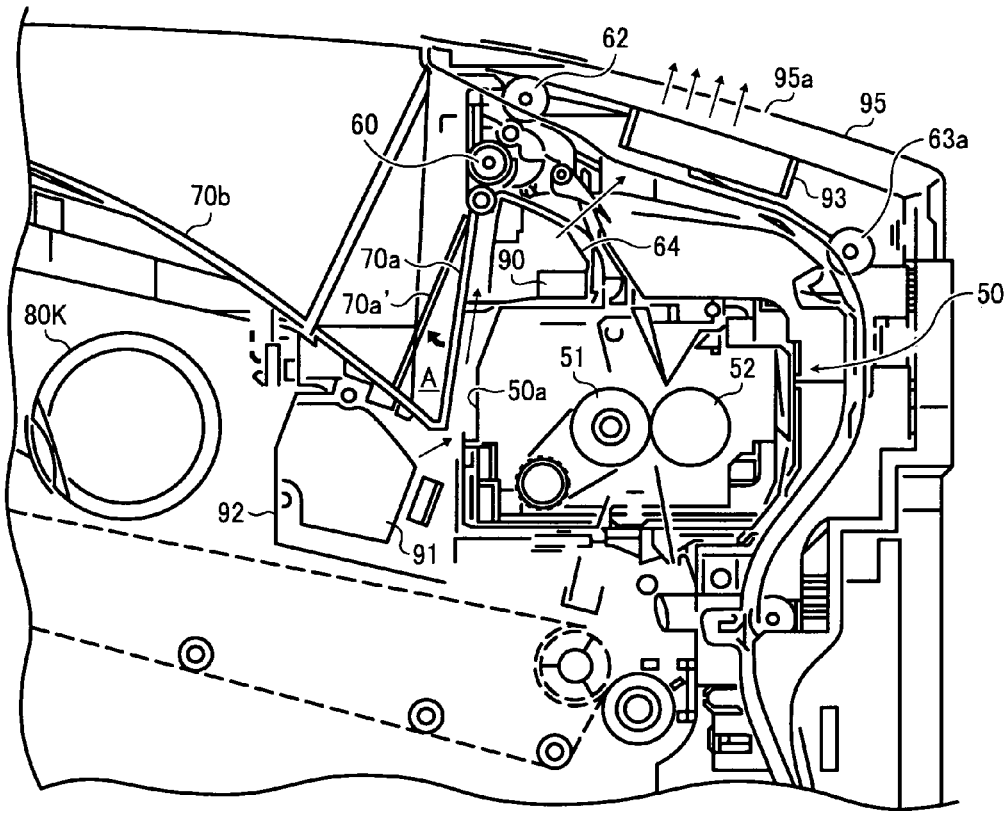
FIG. 6 illustrates a sectional layout in which a sheet material discharge roller is disposed on a front side of a back surface of the fixing unit.

In the first embodiment, as illustrated in FIG. 3, the sheet material discharge roller 60 is disposed at the back surface 50*a* of the fixing unit 50 to sufficiently ensure a clearance between the paper discharge tray 70*a* and the back surface 50*a* of the fixing unit 50, so that the increase in pressure loss of the cooling fan 93 can be prevented to ensure the air volume enough to cool the sheet material P. FIG. 6 illustrates a sectional layout in which the sheet material discharge roller 60 is disposed on a front side of the back surface 50*a* of the fixing unit 50. As illustrated in FIG. 6, a clearance surrounded by a portion A between the paper discharge tray 70*a* and the back surface 50*a* of the fixing unit 50 is narrower than that of FIG. 3. Therefore, the pressure loss of the cooling fan 93 is increased, and possibly the air volume enough to cool the sheet material P cannot be ensured.

The clearance can be enlarged when a paper discharge tray 70*a*' inclined in the direction of FIG. 6 is used instead of the paper discharge tray 70*a*. However, in the case of the paper discharge tray 70*a*', because the paper discharge tray 70*a*' has a large inclination angle with respect to a vertical direction, the sheet material P is easily caught by the paper discharge tray 70*a*' immediately after the sheet material discharge, and possibly the number of sheet materials P that can be stacked on the paper discharge tray 70' is decreased. That is, when the sheet material discharge roller 60 is disposed in front of the back surface 50*a* of the fixing unit 50, it is necessary that the sheet material discharge tray 70*a* be disposed at an angle close to perpendicularity to the sheet material discharge roller 60 in order to ensure a sheet material discharge stacking property. As a result, the clearance between the sheet material discharge tray 70*a* and the back surface 50*a* of the fixing unit 50 becomes narrowed, and possibly a lack of cooling is generated. In the first embodiment, as illustrated in FIG. 3, the sheet material discharge roller 60 is disposed at the back surface 50*a* of the fixing unit 50, so that a balance between the sheet material discharge stacking property and the sheet material cooling can be established. Thus, a positional relationship between the back surface 50*a* of the fixing unit 50 and the sheet material discharge roller 60 is required.

Figure 7:
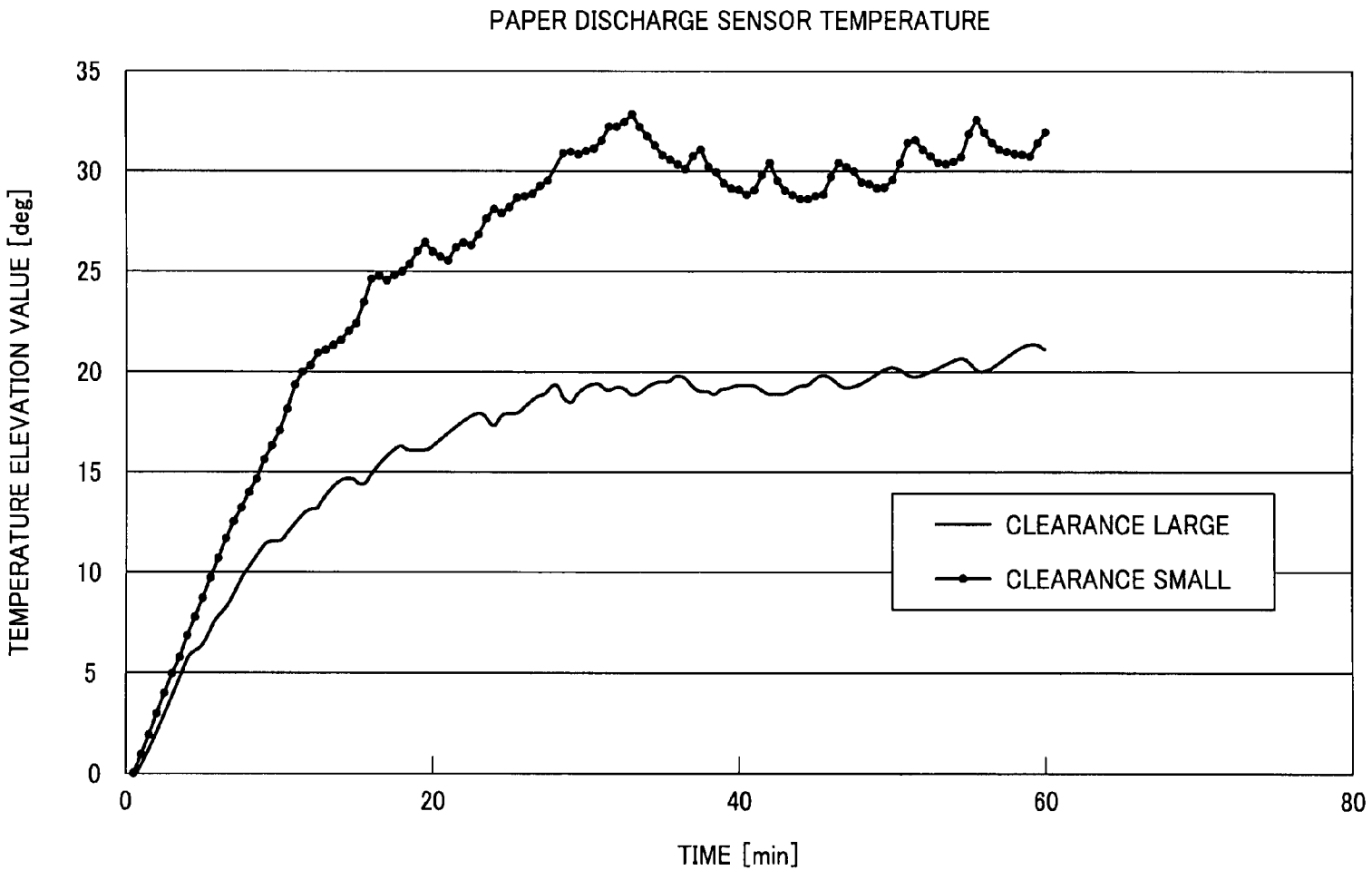
FIG. 7 illustrates temperature evaluation when a paper discharge tray is inclined in the layout of FIG. 6.

Then, in a layout of FIG. 6, temperature evaluation is performed using the paper discharge tray 70*a* and the paper discharge tray 70*a*' in which the paper discharge tray 70*a* is inclined, and an influence of the clearance between the paper discharge tray 70*a* and the back surface 50*a* on temperature is checked. FIG. 7 illustrates temperature history result. FIG. 7 illustrates temperature result of the paper discharge sensor 90 in color double-sided continuous printing. In FIG. 7, a horizontal axis indicates time (minute) and a vertical axis indicates a temperature elevation value from the beginning. As can be seen from FIG. 7, with increasing clearance, a temperature at the paper discharge sensor 90 is lowered by 10° C. or more. The gap between the paper discharge tray 70*a* and the back surface 50*a* of the fixing unit 50 is necessary in the cooling configuration of the first embodiment. Desirably the clearance is equal to or larger than 5 mm.

Second Embodiment

Figure 8:
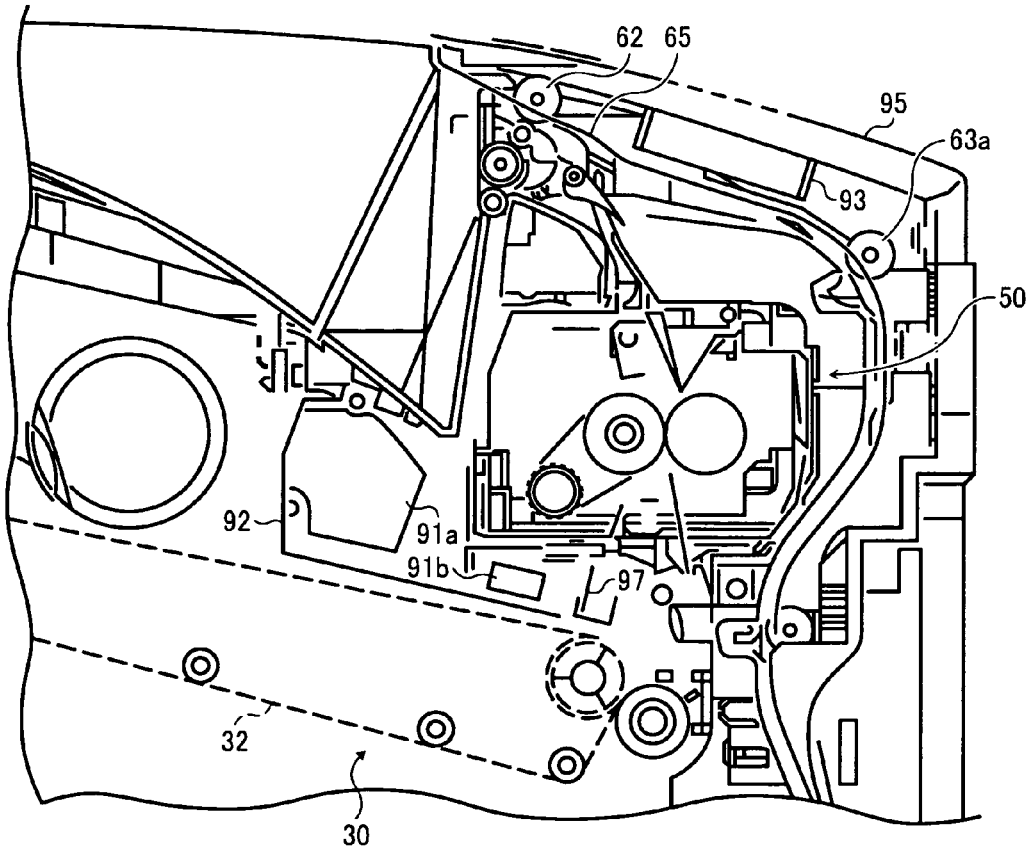
FIG. 8 is a detailed view illustrating a periphery of a fixing unit according to a second embodiment of the inventive concepts.

A second embodiment of the inventive concepts will be described with reference to FIG. 8. FIG. 8 is a detailed view illustrating a periphery of a fixing unit 50 according to a second embodiment of the inventive concepts. A basic configuration of the second embodiment is identical to that of the first embodiment. In FIG. 8, the configuration in common with that of the first embodiment is designated by the same numeral, and the description is not given.

Ventilation holes 91*a* and 91*b* are made on the left side and lower side of the fixing unit 50. Thus, the plural ventilation holes 91*a* and 91*b* may be provided. The duct 92 is disposed so as to surround the ventilation holes 91, and part of the duct 92 is provided between the fixing unit 50 and the transfer unit 30. A TM sensor 97 is provided between the duct 92 and the transfer unit 30. The TM sensor 97 measures a toner density and a position on the transfer belt 32. The TM sensor 97 senses the toner density and position on the transfer belt 32 at intervals of the number of printing sheet, and the sensing result is fed back to form the image. Therefore, a fluctuation in density or position of the image or color shift can be prevented.

As illustrated in FIG. 8, because the TM sensor 97 is disposed between the fixing unit 50 and the transfer unit 30, the temperature of the TM sensor 97 is increased by the heat from the fixing unit 50, and a risk of lowering the sensor function is generated when the temperature of the TM sensor 97 exceeds the allowable temperature. However, in the second embodiment, because the duct 92 is disposed between the TM sensor 97 and the fixing unit 50, the TM sensor 97 is blocked from the heat radiated from the fixing unit 50, and the TM sensor 97 and the transfer unit 30 are not influenced by the fixing unit 50. Therefore, the trouble caused by the heat radiated from the fixing unit 50 can be prevented.

Third Embodiment

Figure 9:
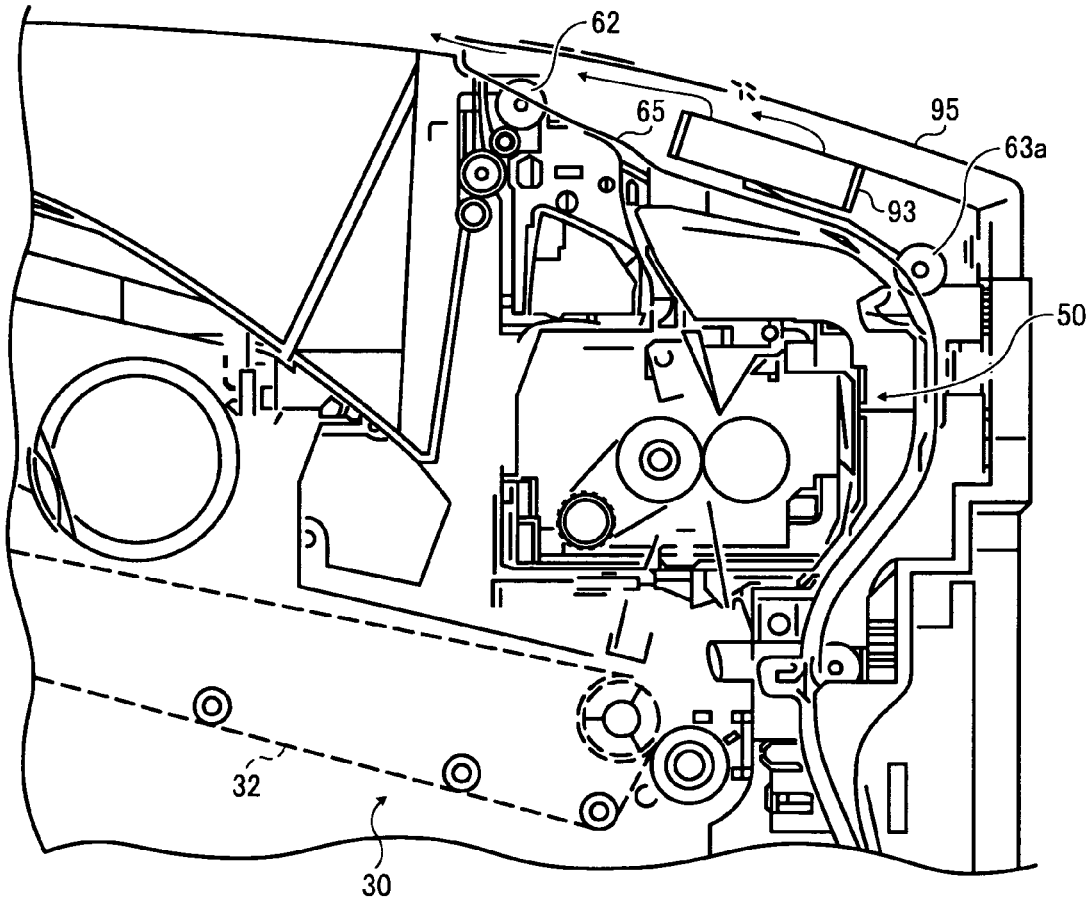
FIG. 9 is a detailed view illustrating a periphery of a fixing unit according to a third embodiment of the inventive concepts.

A third embodiment of the inventive concepts will be described with reference to FIG. 9. FIG. 9 is a detailed view illustrating a periphery of a fixing unit 50 according to a third embodiment of the inventive concepts. A basic configuration of the third embodiment is identical to that of the first embodiment. In FIG. 9, the configuration in common with that of the first embodiment is designated by the same numeral, and the description is not given.

The cooling fan 93 is attached to an inversion guide 65 that guides the conveyance of the sheet material P from the inversion roller 62 to the double-sided roller 63*a*. The flow of the air exhausted from the cooling fan 93 passes through a duct forming portion formed by the inversion guide 65 and the cover 95 and the air is exhausted in the same direction as the discharge direction of the sheet material P. In the configuration of the first embodiment, in the printer, the exhaust direction of the cooling fan 93 becomes the direction of the front surface of the image forming apparatus 100, and the exhaust air directly blows a user. On the other hand, in the configuration of FIG. 9, because the air is exhausted in the same direction as the discharge direction of the sheet material P, the exhaust air does not blow the user.

Additional modifications and variations of the present inventive concepts are possible in light of the above teachings. It is therefore to be understood that within the scope of the appended claims the inventive concepts may be practiced other than as specifically described herein.

What is claimed is:

1. An image forming apparatus comprising:

a fixing unit that heats and fixes a sheet on which an image is formed;

a discharge unit that is provided above the fixing unit to discharge the sheet passing through the fixing unit;

a stacking unit on which the sheet discharged from the discharge unit is stacked;

an inversion guide that is provided above the fixing unit to invert the sheet passing through the fixing unit;

a cooling fan that is disposed to face a guide surface of the inversion guide;

an opening that is provided in the guide surface of the inversion guide to form a flow passage of the cooling fan;

a duct that is formed between the stacking unit and the fixing unit to take in ambient air; and a second duct that is formed between a side end of the fixing unit and an uprising wall to guide air from the duct above the fixing unit, the uprising wall being an upstream end of the stacking unit, wherein the discharge unit is provided on a downstream side of the side end of the fixing unit in a paper discharge direction, and an air flow direction from the duct toward the second duct is substantially matched with a direction in which hot air above the fixing unit is taken in by the cooling fan.

2. The image forming apparatus according to claim 1, wherein a ventilation hole is disposed adjacent to the fixing unit.

3. The image forming apparatus according to claim 1, wherein a ventilation hole is disposed across a sheet material conveying unit from the cooling fan.

4. The image forming apparatus according to claim 1, wherein the cooling fan is disposed in a position except for a neighborhood of an outlet through which a sheet material is discharged from a sheet material conveying unit to the stacking unit.

5. The image forming apparatus according to claim 4, wherein the cooling fan is disposed near an extended line of a line connecting a ventilation hole and the sheet material conveying unit.

6. The image forming apparatus according to claim 1, further comprising a third duct that guides the ambient air from a ventilation hole to a sheet material conveying unit.

7. The image forming apparatus according to claim 6, wherein part of the third duct is disposed between the fixing unit and a transfer unit.

8. The image forming apparatus according to claim 6, wherein a toner storage device is disposed across the third duct from the fixing unit.

* * * * *